United States Patent [19]

Ericsson et al.

[11] Patent Number: 4,891,923

[45] Date of Patent: Jan. 9, 1990

[54] BUILDING STRUCTURE

[76] Inventors: Karl-Gustav Ericsson, Räbbmogatan 40, S-865 00 Alno; Bertil Ericsson, Västergatan 13, S-852 49 Sundsvall, both of Sweden

[21] Appl. No.: 205,329

[22] PCT Filed: Oct. 8, 1986

[86] PCT No.: PCT/SE86/00457

§ 371 Date: Jun. 7, 1988

§ 102(e) Date: Jun. 7, 1988

[87] PCT Pub. No.: WO88/02801

PCT Pub. Date: Apr. 21, 1988

[30] Foreign Application Priority Data

Apr. 10, 1985 [SE] Sweden ..... 8501745
Jul. 17, 1985 [SE] Sweden ..... 8503500

[51] Int. Cl.[4] ..... E04B 1/343; E04B 5/48; E04C 2/46

[52] U.S. Cl. ..... 52/280; 52/309.9

[58] Field of Search ..... 52/280, 309.9, 309.11, 52/588

[56] References Cited

U.S. PATENT DOCUMENTS 3,716,259 2/1973 Weill et al. ..... 52/280
4,125,972 11/1978 Pate ..... 52/90
4,621,467 11/1986 Golden ..... 52/81

FOREIGN PATENT DOCUMENTS 0292650 3/1965 Australia ..... 52/356
0047776 10/1971 Australia ..... 52/81
2436222 9/1979 France ..... 52/309.9

*Primary Examiner*—David A. Scherbel
*Assistant Examiner*—Michele A. Van Patten
*Attorney, Agent, or Firm*—Zarley, McKee, Thomte, Voorhees & Sease

[57] ABSTRACT

A building structure comprises interconnectable structural building elements (1, 2, 3), said structural building elements (1, 2, 3) comprising, for the interconnection, female and male edge portions (4, 5) for engagement with the adjacent structural building elements (1, 2, 3). The structural building elements (1, 2, 3) are formed by two rigid surface layers (6, 7) and a continuous insulating layer (8) located therebetween. The male edge portions (4) are formed by the substantially continuous insulating layer (8) and by the two rigid surface layer (6, 7), each of which comprise a step (9), on the surfaces (10, 11) turned away from the insulating layer (8) in the transition between the male edge portions (4) and the other portions of the structural building elements (1, 2, 3). The female edge portions (5) are formed by solely the two rigid surface layers (6, 7), which are so adapted that they lie closely adjacent to the steps (9) and that their surfaces (10, 11) turned away from the insulating layer (8) form flat surfaces in the transitions between adjacent structural building elements (1, 2, 3), said continuous insulating layer (8) in a structural building element (1, 2, 3) being directly adjacent to the continuous insulating layer (8) in an adjacent structural building element (1, 2, 3), so that a substantially continuous insulating layer (8) is formed in the building structure.

5 Claims, 4 Drawing Sheets

BUILDING STRUCTURE

FIELD OF THE INVENTION AND PRIOR ART

The present invention relates to a building structure comprising interconnectable structural building elements, said structural building elements comprising, for the interconnection, female and male edge portions for engagement with the adjacent structural building elements.

Building structures of the aforementioned type are already well known in the field of building structural engineering. However, these known building structures have a lot of disadvantages such as the creation of thermal bridges between the inner side and the outer side of the building structure, especially in corner and edge regions of the building structure, and the non-obtaining of flat and even surface layers of the building structure in the transitions between the structural building elements.

SUMMARY OF THE INVENTION

The object of the present invention is to provide a building structure having a substantially continuous insulating layer formed between two rigid surface layers in order to avoid thermal bridges.

Another object of the present invention is to provide a strong and resistant building structure having flat and even transitions between structural building elements.

According to the present invention these objects are obtained by the fact that the structural building elements are formed by two rigid surface layers and a continuous insulating layer located therebetween, that the male edge portions are formed by the continuous insulating layers and by the two rigid surface layers, each of which comprise a step on the surfaces turned away from the insulating layer in the transition between the male edge portions and the other portions of the structural building elements, and that the female edge portions are formed solely by the two rigid surface layers, which are so adapted that they lie closely adjacent to the steps and that their surfaces turned away from the insulating layer form flat surfaces in the transitions between adjacent structural building elements, said continuous insulating layer in a structural building element being directly adjacent to the continuous insulating layer in an adjacent structural building element, so that a substantially continuous insulating layer is formed in the building structure.

In this way, the present invention achieves the advantage that the building structure gets comparatively strong with even, flat transitions, between the structural building elements and get a substantially continuous insulating layer which is the only thing that interconnect the rigid surface layers.

Further objects and advantages will appear from the appended dependent claims.

BRIEF DESCRIPTION OF THE DRAWINGS

The invention will now be described by means of an example of an embodiment with reference made to the enclosed drawings, on which.

DETAILED DESCRIPTION OF A PREFERRED EMBODIMENT OF THE INVENTION

Figure 1:
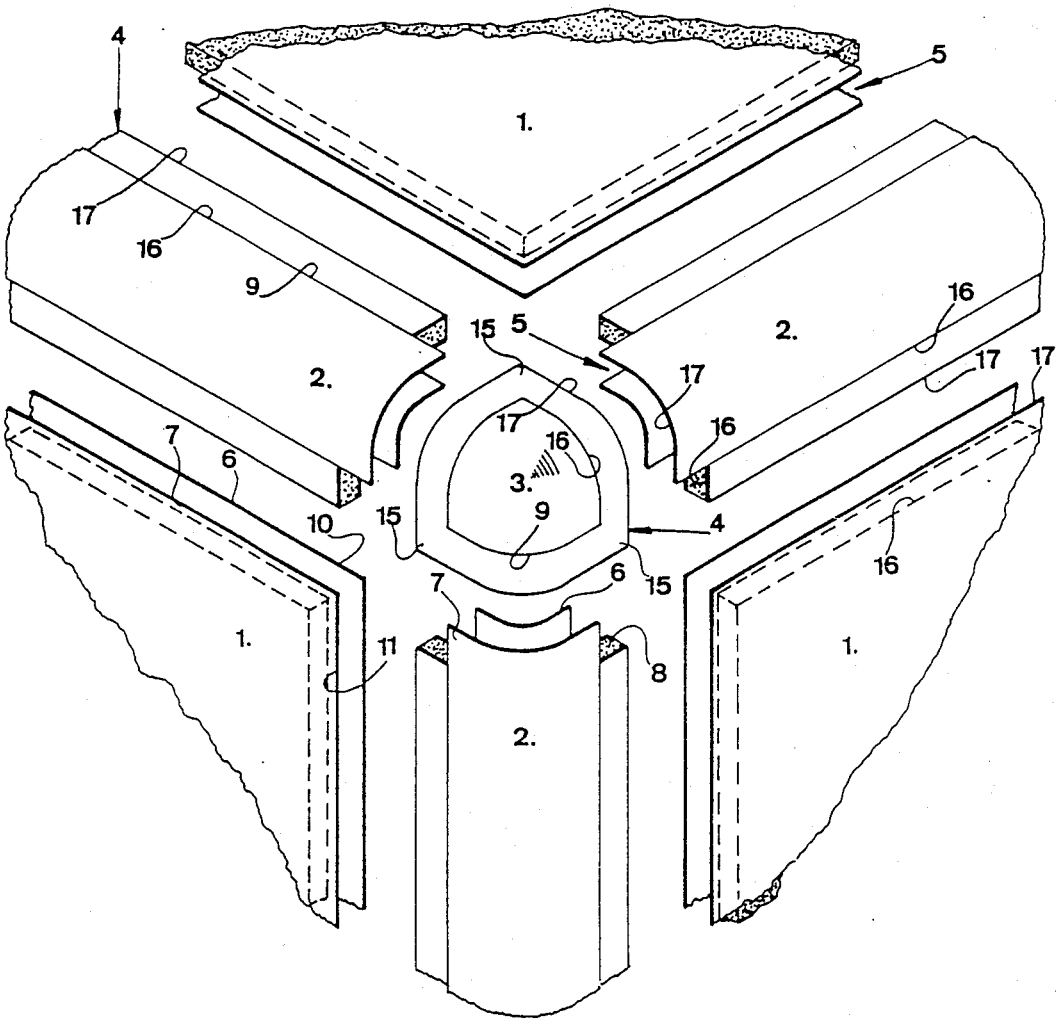
FIG. 1 is a partial perspective view of a corner of the building structure according to the invention in a not assembled state.
Figure 2:
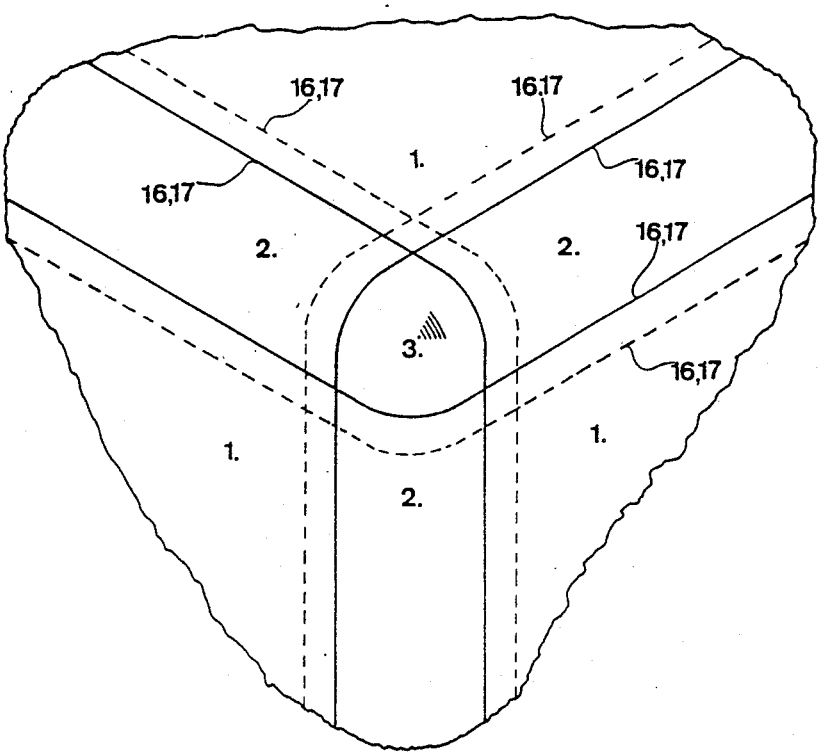
FIG. 2 is a view similar to the one in FIG. 1, but in an assembled state.
Figure 3:
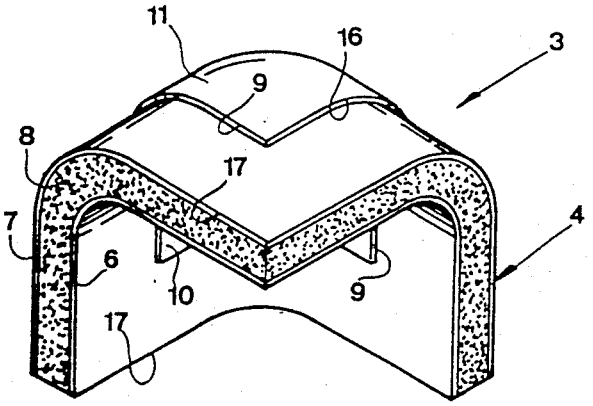
FIG. 3 is a perspective view of the corner structural building element shown in FIG. 1 and 2.
Figure 4:
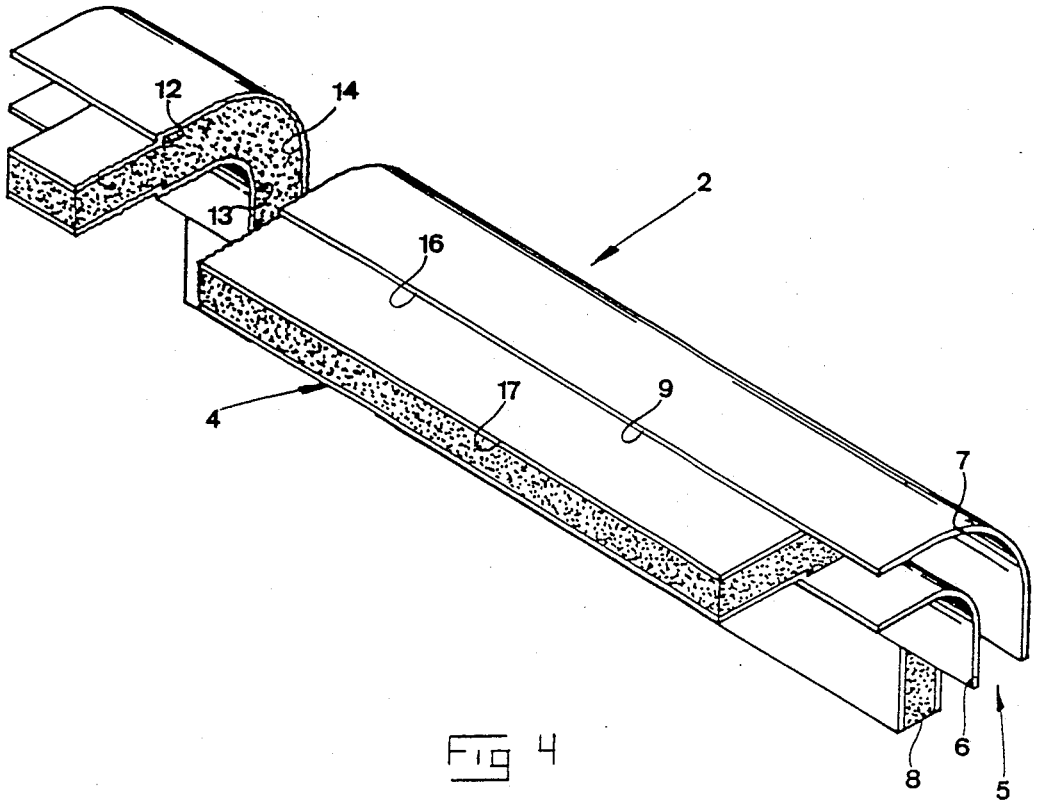
FIG. 4 is a perspective view of one of the three edge structural elements in FIG. 1 and 2 cut-off transversally to its longitudinal direction.

In the FIGS. 1–4 a preferred embodiment of the building structure according to the invention is shown. The building structure comprises structural building elements 1, 2, 3 being interconnectable by means of female and male edge portions 4, 5 on the structural building elements 1, 2, 3 in question.

The structural building elements 1, 2, 3 are formed by two rigid surface layers 6, 7 and a continuous insulating layer 8 located therebetween.

The male edge portions 4 of the structural building elements 1, 2, 3 are formed by the continuous insulating layer 8, which has a smaller thickness in the male edge portion 4 than in the other portions of the structural building elements, and by the two rigid surface layers 6, 7, each of which forma step 9 in the transition between the male edge portions 4 and the other portions of the structural building elements 1, 2, 3.

The female edge portions 5 are formed by solely the two rigid surface layers 6, 7, which are so adapted that they lie closely adjacent to the steps 9 and that their surfaces 19, 11 turned away from the insulating layer 8, i.e. the visible internal and external surfaces of the structural building elements 1, 2, 3, form flat surfaces in the transitions between the adjacent structural building elements 1, 2, 3.

The steps 9 in the surface layers 6, 7 may be formed in different ways. They made be formed either in a surface layer 6, 7 itself or by arranging the surface layers 6, 7 comprised in the male edge portions 4 inside the surface layer 6, 7 of the structural building elements 1, 2, 3 and overlapped thereby.

In the embodiment shown a further step 12 is formed. This step 12 is established on the surfaces 13, 14 turned towards the insulating layer 8 in the transition between adjacent structural building elements 1, 2, 3, when the structural building elements 1, 2, 3 are interconnected. However, this step 12 may be removed, so that the surfaces 13, 14 facing the insulating layer 8 get just as even and flat in the transition between the adjacent structural building elements 1, 2, 3 as the surfaces 10, 11. The insulating layer 8 is then getting the same thickness in the transition between the adjacent elements 1, 2, 3 as in the other portions of the elements 1, 2, 3. The removal of the step 12 may be achieved by the fact that the rigid surface layers 6, 7 of the female and male edge portions 4, 5 have a total thickness corresponding to one surface layer 6, 7 beside the edge portions.

In FIG. 1 three different types of structural building elements 1, 2, 3 are shown, namely a first type of flat structural building elements 1, a second type of structural building elements 2 forming a portion of an envelope surface of a tube and a third type of structural building elements forming a portion of a hollow sphere.

The third tpye of structural building elements 3 (see FIG. 3) comprises three male edge portions 4 for receiving three structural building elements 2 of the second type. The structural building element 3 of the third type is in the preferred embodiment so adapted that the three structural building elements of the second type are orientated perpendicularly to each other. In the preferred embodiment the structural building element 3 of the third type receives also three structural building elements 1 of the first type in the corners 15 between the male edge portions 4.

The second type of structural building element 2 comprises in the preferred embodiment two opposed female edge portions 5 each intended to receive the male edge portion 4 of a respective structural building element 3 of the third type and two male edge portions arranged perpendicularly to each other and each intended to receive a female edge portion 5 of a respective structural building element 1 of the first type. The structural building elements 2 of the second type are symmetrical with respect to on one hand a line extending from a female edge portion 5 to the one opposite thereto and on the other with respect to a line extending from a male edge portion 4 to the one opposite thereto.

The structural building element 1 of the first type has four female edge portions 5 intended to receive four structural building elements 2 of the second type as well as four structural building elements of the third type in the corners between the edge portions 5.

The edge portions 4 and 5 are delimited of inner edges 16, 16', 16" and outer edges 17, 17', 17" and the insulating layer 8 is terminated in a section either at the inner or at the outer edges, said insulating layer being rectangular in the structural building elements of the first and second types.

The inner edges 16, 16', and 16" along an edge portion 4, 5 of a structural building element 1, 2, 3, respectively, are closely adjacent to the outer edges 17, 17', and 17" of an edge portion 4, 5 of an adjacent structural building element 1, 2, 3, respectively. Adjacent inner and outer edges 16, 16', 16", 17, 17', 17" have the same lengths.

The inner and outer edges of a structural building element 1, 2, 3 are parallel to each other.

Figure 5:
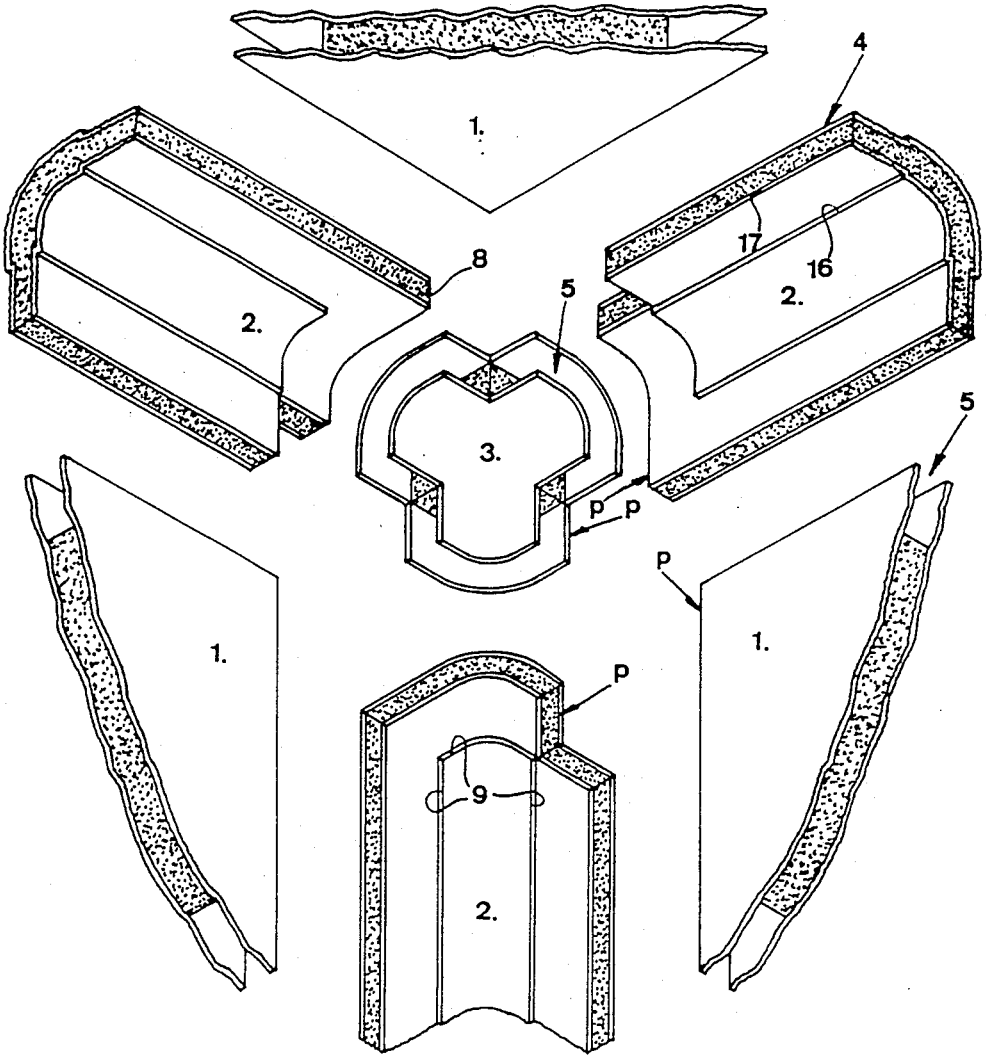
FIG. 5 is a view of a second embodiment of the building structure according to the invention from the opposite direction with respect to the view in FIG. 1.

FIG. 5 illustrates another embodiment of the invention. This embodiment shall exemplify the possibility to have other combinations between the female-male edge portions 4, 5, see for example the structural building element of the second type which here has only male edge portions 4. A disadvantage of this embodiment consists of the fact that the labyrint effect achieved in the embodiment according to FIG. 1–4 i.e. there are no joint extending straight through the building structure, is not obtained, see for example the arrows P. Thus, the invention is of course not to be considered as restricted to an embodiment with the female-male edge portions 4, 5 arranged as it appears from the embodiment shown.

Furthermore, it is evident that the invention with respect to other details are not restricted to the embodiment shown above, but the invention may be modified in a plurality of ways without diverting from the idea of the invention. For example, the angles of the structure elements 2, 3 may be other than right angles. Furthermore, the insulating layer 8 may protrude more than the rigid surface layer 6, 7 in order to further increase the labyrint effect. In the practice the insulating layer 8 may be produced from cellular plastic, while the surface layers 6, 7 are produced from more rigid plastic. The insulating layer and the surface layers may be separately free-manufactured and assembled by gluing. Alternatively, the insulating layers may be formed by extruding foamed plastic between pre-manufactured surface layers, held in a mould or the like. In the assmebling of the structural building elements cementing of the rigid layers of the female and male edge portions and also of the surfaces of the insulating layers bearing against each other are preferably carried out. After the assemblage covering material, putty or the like is applied in the joints at the steps 9, so that completely even outer and inner surfaces are obtained, whereupon possibly painting or other surface treatment may take place.

We claim:

1. A building structure comprising:

interconnectable structural building elements (1, 2, 3) formed by two rigid surface layers (6, 7) and a continuous insulating layer (8) located therebetween, said continuous layer (8) in one of said structural building elements (1, 2, 3) being directly adjacent to the continuous insulating layer (8) in an adjacent structural building element (1, 2, 3), so that a substantially continuous insulating layer (8) is formed in the building structure, said structural elements (1, 2, 3) comprising for the interconnection, female and male edge portions (4, 5) for engagement with the adjacent structural building elements (1, 2, 3), said male edge portions (4) being formed by the continuous insulating layer (8) and the two rigid surface layers (6, 7), whereas the female edge portions (5) are formed by the two rigid surface layers (6, 7), the two rigid surface layers (6, 7) including a step (9) arranged on their external surfaces (10, 11) extending away from the insulating layer (8) adjacent the male edge portions (4), said steps (9) being so arranged and adapted that the rigid surface layers (6, 7) of the female edge portions (5) lie closely adjacent to the rigid surface layers (6, 7) of the male edge portions and to the step (9) and form a substantially flat surface, at least on external surfces of the building structure facing away from the insulating layer, in the transitions between the adjacent structural building elements (1, 2, 3), the structural building elements (1, 2, 3) being of three different shape types, namely a first type of flat structural building elements (1), a second type of structural building elements (2) forming a portion of an envelope surface of a tube, and a third type of structural building elements (3) forming a portion of a hollow sphere, and said third building element (3) comprising three corner regions (15), between which it engages with the second building elements (2) by means of said male and female edge portions (4, 5), said third building element (3) also engaging in the corner regions (15) thereof with the first building elements (1) by means of said male and female edge portions (4, 5);

the third building element (3) having male edge portions (4) extending entirely around its circumference and these male edge portions being received between female edge portions of the first building elements (1) in the corner regions (15) of the third building element (3).

2. A building structure according to claim 1, wherein the rigid surface layers (6,7) of the female-male edge portions (4, 5) have a total thickness corresponding to the thickness of one surface layer beside the edge portions.

3. A building structure according to claim 1, characterized in that the second building element (2) has a symmetry line extending from that edge portion (5) of said second building element (2) which is in engagement with a third building element (3) to the opposite edge portion (5) of the second building element.

4. A building structure according to claim 1, wherein the female-male edge portions (4, 5) are delimited by extreme edges (17) and inner borders (16), respectively, said inner borders being located at the steps on the male edge portions and at bases of the female edge portions, and that the insulating layer (8) in a section is terminated either at the inner borders (16) or at the extreme edges (17).

5. A building structure according to claim 4, characterized in that the inner border (16) along an edge portion (4, 5) of a structural building element (1, 2, 3) lies closely adjacent to an extreme edge (17) of an edge portion (4, 5) of an adjacent structural building element (1, 2, 3), said inner border (16) and extreme edge (17) having the same length, and that the extreme edge (17) along the edge portion (4, 5) first mentioned of the first mentioned structural building element (1, 2, 3) lies closely adjacent to the inner border (16) of the latter edge portion (4, 5) of the latter adjacent structural building element (1, 2, 3), said extreme edge (17) of the first mentioned edge portion (4, 5) and the inner border (16) of the latter edge portion (4, 5) having the same length.

* * * * *